US009920933B2

(12) United States Patent
Petersen et al.

(10) Patent No.: US 9,920,933 B2
(45) Date of Patent: Mar. 20, 2018

(54) WAIST-HIGH BROILER FOR OFF-GRID PROPANE GAS RANGE APPLIANCE

(71) Applicant: UNIQUE GAS PRODUCTS, LTD, Oakville (CA)

(72) Inventors: Steven Petersen, Oakville (CA); Paul Petersen, Georgetown (CA); Michael Scott, Cheltenham (CA); Tim Dean, Mississauga (CA); Kyle Maynard, Grimsby (CA); Ryan Brooks, Grimsby (CA); Chris Duke, Waterdown (CA); Carl Suchovsky, Walton Hills, OH (US)

(73) Assignee: Unique Gas Products LTD (CA)

( * ) Notice: Subject to any disclaimer, the term of this patent is extended or adjusted under 35 U.S.C. 154(b) by 601 days.

(21) Appl. No.: 14/581,172

(22) Filed: Dec. 23, 2014

(65) Prior Publication Data

US 2016/0178214 A1 Jun. 23, 2016

(51) Int. Cl.

| | |
|---|---|
| ***F24C 3/12*** | (2006.01) |
| ***F24C 3/10*** | (2006.01) |
| ***F24C 3/02*** | (2006.01) |
| *F24C 3/08* | (2006.01) |

(52) U.S. Cl.
CPC ..... *F24C 3/10* (2013.01); *F24C 3/027* (2013.01); *F24C 3/126* (2013.01); *F24C 3/08* (2013.01)

(58) Field of Classification Search
CPC .. F24C 3/027; F24C 3/126; F24C 3/10; F24C 3/08
See application file for complete search history.

(56) References Cited

U.S. PATENT DOCUMENTS 3,259,121 A * 7/1966 McGee ..... F24C 3/128 126/39 E

* cited by examiner

*Primary Examiner* — Alfred Basichas
(74) *Attorney, Agent, or Firm* — Emerson Thomson Bennett, LLC; Daniel A. Thomson

(57) ABSTRACT

The invention relates to an off-grid propane gas range appliance incorporating a waist-high broiler, the gas range operating without electricity in off-grid applications. The off-grid propane gas range appliance comprises an oven compartment having a first heating element or baking burner arranged at the bottom of the oven compartment and a second heating element or a broiling burner arranged at the top of the oven compartment eliminating the need for a separate broiler drawer. The first and second heating elements are arranged and connected to the main gas manifold of the gas range so that only one of the heating elements is operable at a single time.

19 Claims, 7 Drawing Sheets

WAIST-HIGH BROILER FOR OFF-GRID PROPANE GAS RANGE APPLIANCE

TECHNICAL FIELD

The invention relates to an off-grid propane gas range appliance incorporating a waist-high broiler, the gas range operating without electricity in off-grid applications.

BACKGROUND

Propane gas ranges that are capable of operating in remote or "off-grid" areas that do not have access to electricity are known. Traditional propane gas ranges generally include a cook-top or cooking surface with various cooking elements or burners as well as an oven cavity or compartment equipped with a baking element capable of generating heat and directing it upwards through the oven cavity. A separate broil drawer has traditionally been provided at the base or bottom of the gas range appliance underneath the oven compartment. Broil drawers arranged at the bottom of the appliance underneath the oven compartment have been known to be inconvenient and awkward to use.

Traditional electric, on-grid appliances, whether they are on-grid gas ranges or purely electric ranges, also generally include a cook-top or cooking surface with multiple elements or burners and an oven compartment. In on-grid appliances, however, the oven compartment is generally equipped with both a bake element as well as a broil element, commonly referred to as a waist-high broiler, which is generally considered to be convenient and easy to use. Waist-high broilers have not been available to users in off-grid applications for various reasons. For instance, off-grid gas ranges were at one time equipped with standing pilots, the gas range relying on the standing pilots for operation of the heating elements or burners associated with the gas range. While standing pilots were acceptable for use with the burners provided on the cooking surface, difficulties were encountered when attempting to equip the oven compartment with both a baking element (arranged at the bottom of the oven cavity) and a waist-high broiling element arranged a the top of the oven compartment since whenever one of the heating elements was in use, the products of combustion associated with either the baking element or baking burner or the broiling element or broiling burner would have the tendency to snuff-out the standing pilot associated with the element or burner not in use. This was considered to be inconvenient and unacceptable for users since the process of re-lighting the standing pilots was considered difficult and cumbersome. It was for this reason that wait-high broilers were not incorporated into the oven compartment of off-grid gas range appliances. By arranging the broiling element in a separate broil drawer, the problem of snuffing-out the standing pilot associated with the burner not in use was avoided since the standing pilots were arranged in different compartments of the gas range appliance.

Safety regulations eventually mandated the elimination of standing pilots. While the issue of snuffing-out the standing pilots associated with a baking element and broiling element was no longer one of the main challenges associated with incorporating a waist-high broiler into an off-grid gas range appliance, incorporating a waist-high broiler into the oven compartment while meeting specific safety regulations mandated by the off-grid industry still proved to be challenging with manufacturers still opting for a separate broil drawer feature or simply eliminating the broil feature from the gas range appliance altogether.

The convenience and functionality of a waist-high broiler as is known in conventional on-grid appliances cannot be denied. Accordingly, there has been a long-standing need and desire to incorporate a waist-high broiler into the oven compartment of an off-grid gas range appliance while meeting the specific safety regulations mandated by the industry so as to afford users and/or customers in the off-grid market the same convenience and functionality provided to on-grid users/customers.

Accordingly, there is a need for an improved off-grid gas range that incorporates a boil feature that is convenient to use and cost-effective to manufacture that also meets and maintains specific design requirements as well as specific government mandated safety standards for off-grid appliances.

SUMMARY OF INVENTION

According to an exemplary embodiment of the present disclosure there is provided an off-grid propane gas range appliance, comprising a cooking surface having a plurality of cooking elements, each cooking element having a pilot burner; an oven compartment; a first heating element arranged within the oven compartment at a bottom portion thereof for supplying heat to the oven compartment for baking, the first heating element having a gas circuit powering said first heating element; a second heating element arranged within the oven compartment at a top portion thereof for supplying heat to the oven compartment for broiling, the second heating element having a gas circuit powering said second heating element; an oven heating element selector having a first position for selecting operation of the first heating element and a second position for selecting the second heating element for operation; wherein only one of the first and second heating elements is operational at one time.

BRIEF DESCRIPTION OF THE DRAWINGS

Reference will now be made, by way of example, to the accompanying drawings which show example embodiments of the present application, and in which.

Similar reference numerals may have been used in different figures to denote similar components.

DESCRIPTION OF EXAMPLE EMBODIMENTS

Figure 1:
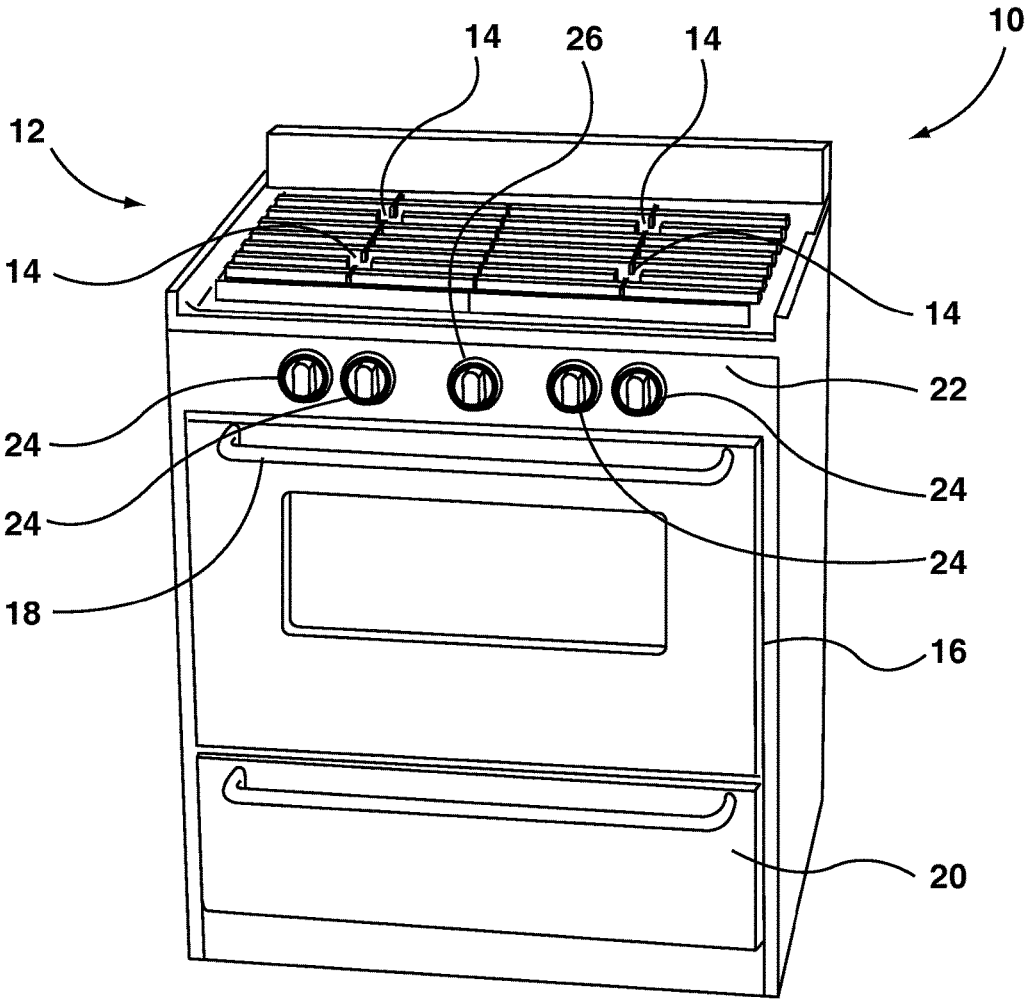
FIG. 1 (Prior Art)
FIG. 1 is a perspective view of a traditional off-grid gas range appliance.

Referring now to FIG. 1 there is shown a traditional or conventional off-grid gas range appliance 10 as is known in the art. As shown, the traditional off-grid gas range appliance 10 is typically fueled by a propane gas supply and generally comprises a cooking surface 12 incorporating various gas cooking elements or burners 14 arranged at various locations on the cooking surface 12. An oven compartment 16 is arranged underneath the cooking surface 12 having a door 18 that opens to provide access to the oven compartment 16, the oven compartment 16 being equipped with a heating element 17 at the bottom portion thereof for directing heat upwards within the oven compartment 16 for baking purposes. A separate broil drawer 20 is arranged at the base of the gas range appliance 10 underneath the oven compartment 16. The heating element 17 is arranged so as to be in communication with the separate broil drawer 20 as well as the oven compartment, the heating element capable of directing heat downwards through the broil drawer 20 for broiling purposes. Therefore, the heating element is capable of providing heat to either the oven compartment 16 for baking or to the broil drawer 20 for broiling purposes. A control panel 22 is arranged across the front of the gas range 10 with individual control knobs 24 for turning on/off each of the individual cooking elements or burners 14 forming part of the cooking surface 12. A separate control knob 26 operates the baking element within the oven compartment and/or the broil element within the separate broil drawer 20.

Each of the cooking elements or burners 14 is equipped with a gas burner associated with a corresponding gas valve that directs propane gas from the gas supply to the associated cooking element or burner 14, which gas is ignited either manually or by means of a battery powered spark igniter for example, when the burner 14 on the cooking surface 12 is activated. When heat from the cooking element or burner 14 is no longer required, the corresponding gas valve is closed via the associated control knob 24 which cuts of the gas supply to the burner 14 snuffing out the gas flame from the gas burner.

The heating element 17 for the oven compartment 16 or for the separate broil drawer 20 of the traditional or conventional off-grid gas range appliance 10 generally operates in a similar manner to the cooking elements or burners 14 associated with the cooking surface 12 with gas being supplied to a pilot light associated with the heating element (not shown), the gas being ignited by means of a battery powered spark igniter that serves to ignite the pilot light associated with the heating element forming a gas flame for supplying heat to either the oven compartment 16 for baking or to the broil drawer 20 for broiling depending upon the selection made by the user with control knob 26. Traditional off-grid gas ranges 10 do not include a separate broil element arranged at the top of the oven compartment 16, as in the case of traditional on-grid ranges and generally only provide the one heating element that can be used for either baking in the oven compartment 16 or for broiling in the separate broil drawer 20 arranged at the bottom of the gas range 10 underneath the oven compartment 16. While the provision of a broiler drawer 20 that is separate to the oven compartment allows for a user to select between the two different cooking functions, broiler drawers 20 arranged underneath the oven compartment 16 at the base of the appliance are known to be inconvenient and awkward to use due to their location at the base or bottom of the gas range appliance 10. In some instances, it has been known to completely eliminate the separate broiler drawer 20, the off-grid gas range appliance 10 therefore providing only a cooking surface 12 and an oven compartment 16 with a bake setting with no broiler function being provided. While it was desirable to incorporate the broiling element into the oven compartment 16 to arrive at a gas range appliance 10 that offered all of the conveniences of traditional/conventional on-grid appliances, specific safety regulations mandated by the off-grid, propane gas appliance industry requiring that both the bake function and the broil function not be operational at the same time made the incorporation of a waist-high broiler into the off-grid gas range appliance challenging.

Figure 2:
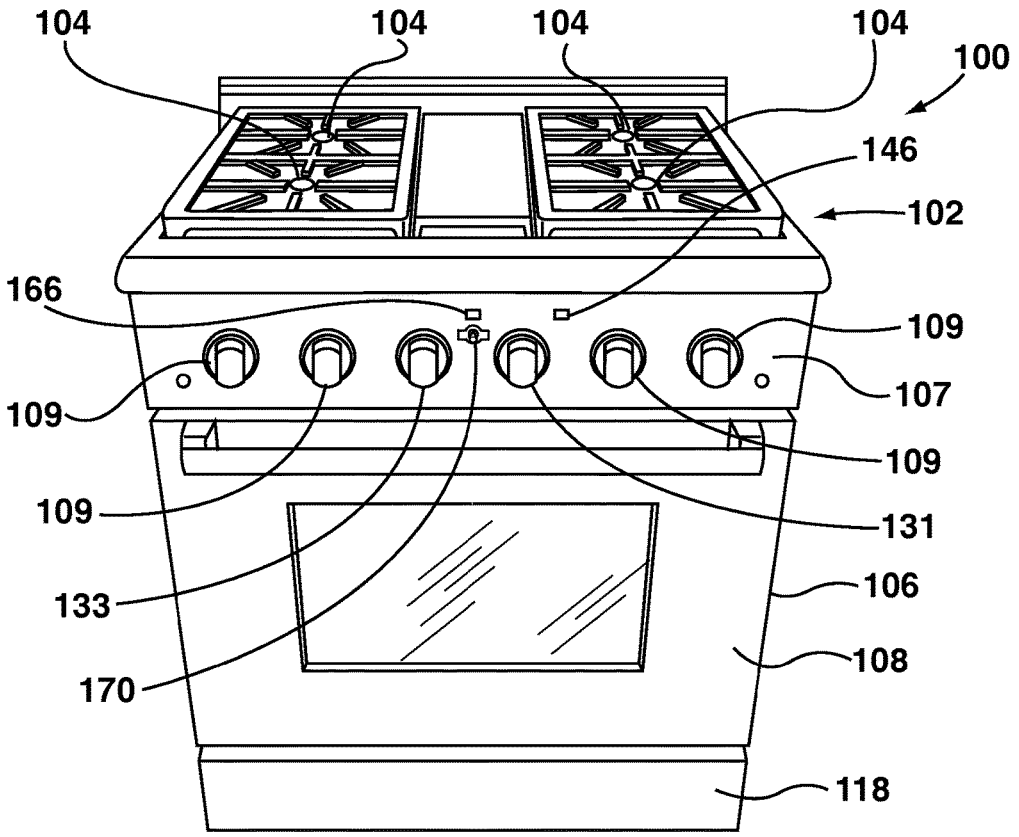
FIG. 2 is a front perspective view of an example embodiment of the off-grid gas range appliance according to the present disclosure.

Referring now to FIGS. 2 and 3 there is shown an off-grid gas range appliance 100 according to an example embodiment of the present disclosure. The off-grid gas range 100 comprises a cooking surface 102 incorporating various gas cooking elements or burners 104 arranged at various locations on the cooking surface 102. An oven compartment 106 is arranged underneath the cooking surface 102, the oven compartment having a door 108 that opens to provide access to the oven compartment 106. A control panel 107 is arranged across the front of the off-grid gas range 100 having individual control knobs 109 for turning on/off each of the individual cooking elements or burners 104 that form part of the cooking surface 102 as well as for operating the bake and broil elements 130, 131, 133 that form part of the oven compartment 106 as will be described in further detail below.

Figure 3A:
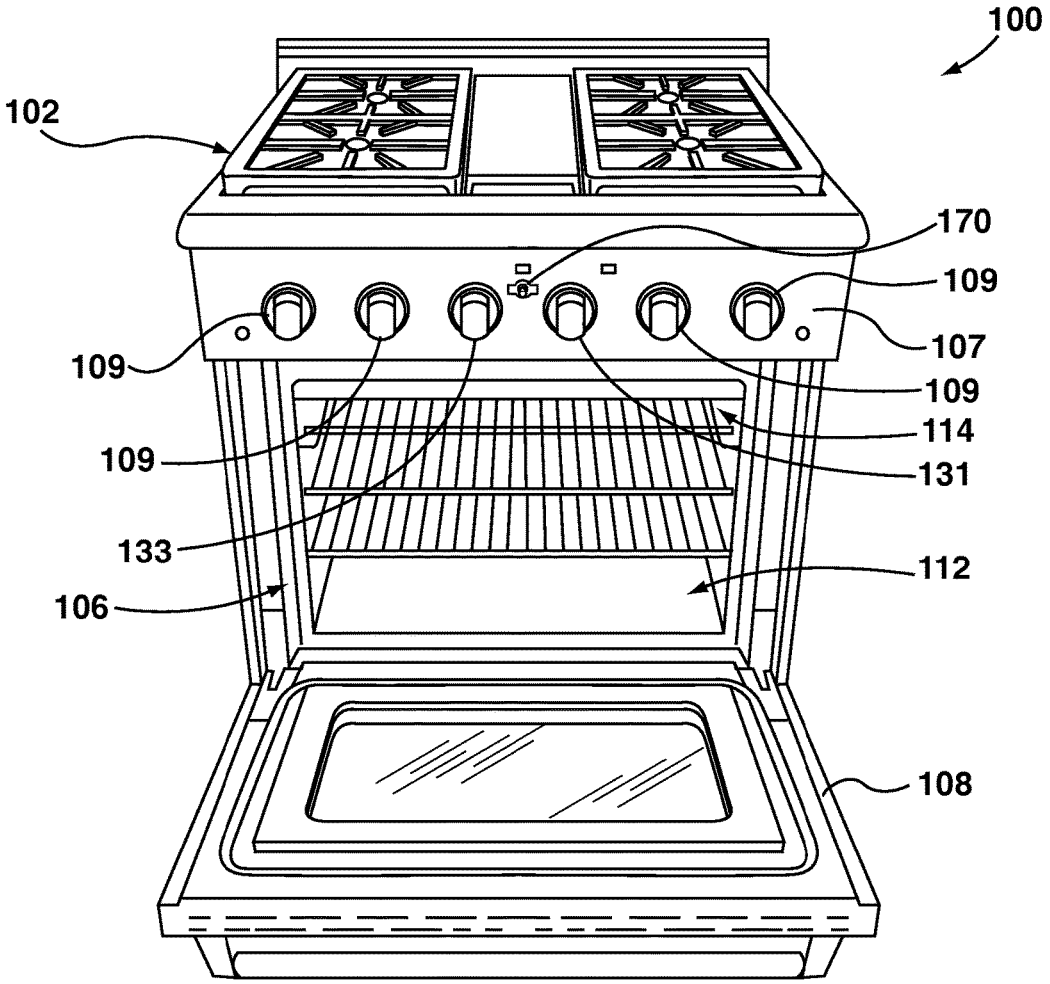
FIG. 3A is a front perspective view of the off-grid gas range appliance of FIG. 2 in the open condition.
Figure 3B:
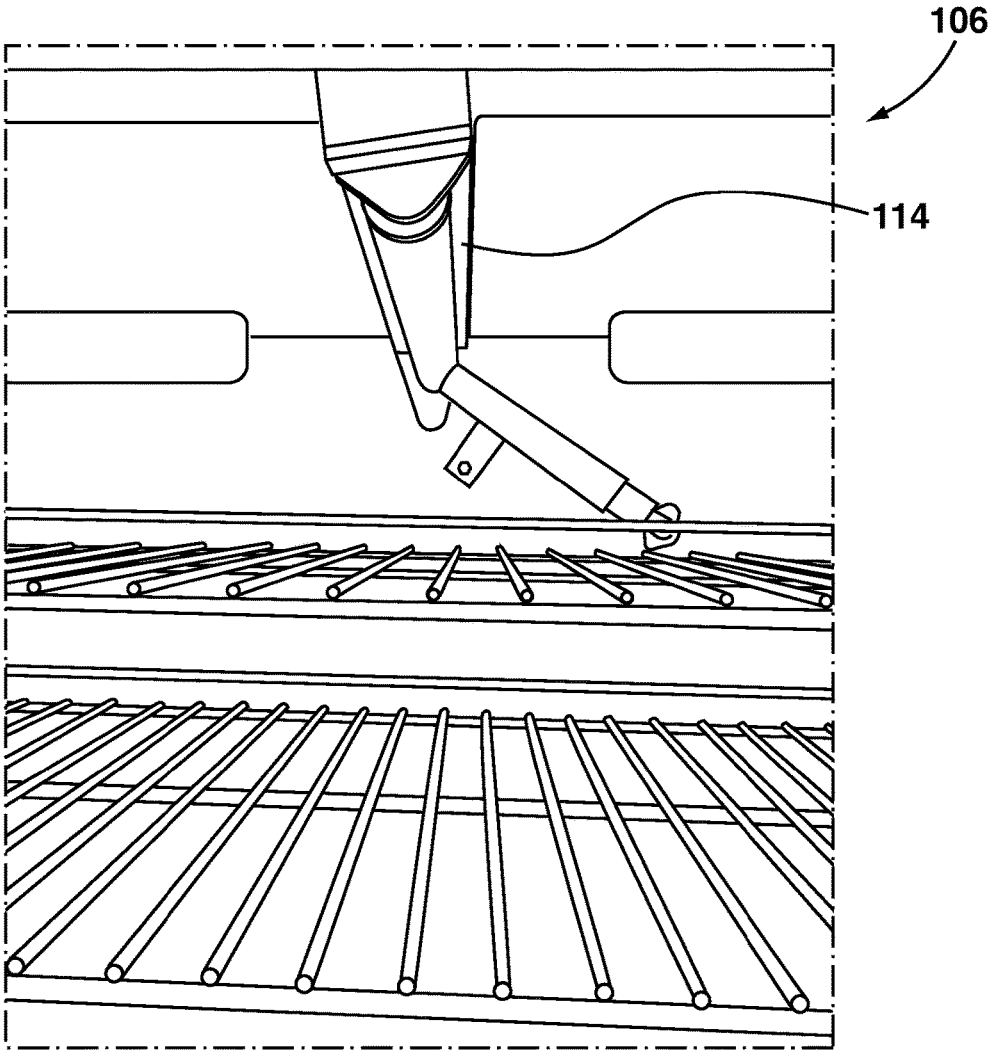
FIG. 3B is a detail view of the top or upper portion of the oven compartment as shown in FIG. 3A illustrating the waist-high broiler element.

Referring now to FIGS. 3A and 3B, the oven compartment 106 is equipped with a first heating element or baking element 112 arranged at the bottom of the oven compartment 106 for directing heat upwards within the oven compartment 106 for cooking or baking purposes using the bake setting of the off-grid gas range 100. A second heating element or broil element 114 is arranged at the top 116 of the oven compartment 106 for directing heat downwards within the oven compartment 106 for broiling purposes using the broil setting of the gas range 100. A separate storage drawer 118 may or may not be provided at the base of the off-grid gas range 100 underneath the oven compartment 106. However, this drawer 118 is purely intended for storage and/or aesthetic purposes and is not equipped with any sort of broiling element as in the case of the traditional or conventional off-grid gas range appliance 10 shown in FIG. 1.

Operation of the bake and broil settings of a first example embodiment of the off-grid gas range 100 will now be described in further detail having regard to FIG. 4.

Figure 4:
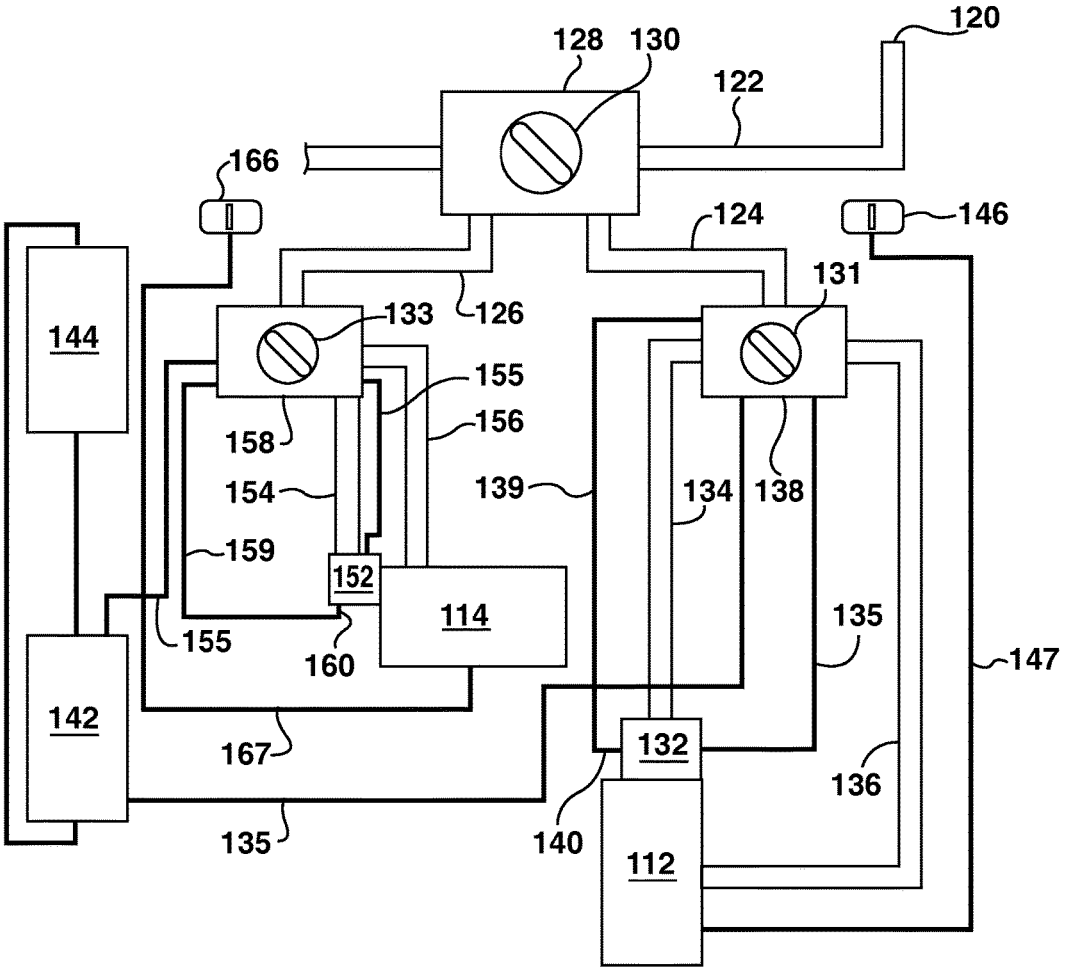
FIG. 4 is a schematic diagram of an example embodiment of the gas circuit associated with the operation of the oven compartment of the off-grid gas range appliance of FIG. 2.

As illustrated in FIG. 4, the gas range 100 is supplied with propane gas (or any other suitable fluid) through gas inlet 120 where it is distributed to the various gas circuits powering the various cooking elements or burners 104 on the cooking surface 102 as well as to the first and second heating elements 112, 114 within the oven compartment 106 via a gas manifold 122. The individual cooking elements or burners 104 on the cooking surface 102 operate in accordance with principles known in the art as described briefly above in connection with FIG. 1 and will not be described in further detail.

Turning now to the bake and broil settings, the bake and broil settings associated with the oven compartment 106 of the gas range 100 both operate in a similar manner. A first gas line 124 is provided in fluid communication with the gas manifold 122 for supplying propane gas for operating the bake setting of the oven compartment 106 and a second gas line 126 is provided in fluid communication with the gas manifold 122 for supplying propane gas for operating the broil setting of the oven compartment 106.

A gas valve selector 128 is operably coupled and arranged at the junction of the gas manifold 122 and the first and second gas lines 122, 124, the gas valve selector 128 operating to allow a user to select between directing propane gas from the gas manifold 122 to either the first or second gas line 124, 126, e.g. to either the bake or broil function of the oven compartment 106. A control knob 130 for operating the gas valve selector 128 is arranged on the control panel 107 at the front of the gas range 100 for allowing the user to conveniently and easily select between a true "OFF" position and the two oven functions, e.g. "BAKE" or "BROIL". Since standard safety regulations and/or certification requirements for off-grid gas ranges dictate that the bake and broil elements (e.g. the first and second heating elements 124, 126) cannot both be operational at the same time, gas selector 128 ensures that only one of the first and second gas lines 124, 126 is open at one time. Once the gas valve selector 128 has been activated to select between opening the gas line associated with either the bake or broil function of the gas range 100, the user will then activate the corresponding one of the bake and broil setting control knobs 131, 133 arranged on the control panel 127 of the gas range appliance 100 in order to initiate the ignition of either the bake or broil heating element 112, 114 as will be described in further detail below.

With regard to the bake setting, as set out above, the oven compartment 106 is equipped with a first heating element (or baking burner) 112 arranged at the bottom of the compartment 106. The first heating element 112 is activated by the associated control knob 131 on the control panel 127 and has a corresponding pilot burner 132, the first heating element 112 and pilot burner 132 each being supplied with propane gas through corresponding gas supply lines, namely a pilot burner gas line 134 and a baking burner gas line 136 both of which are arranged in fluid communication with the first gas line 124. A thermostat or control valve 138 is arranged at the junction of the first gas line 124 and the baking burner gas line 136 for controlling whether propane gas from the gas manifold 122 is delivered to the first heating element 112 through the baking burner gas line 136, the thermostat or control valve 138 being operably coupled to the pilot burner 132 associated with the first heating element 112 via a control circuit or feedback loop 139 interconnecting the pilot burner 132 and the thermostat or control valve 138. Therefore, only once the pilot burner 132 is ignited, will the thermostat or control valve 138 be activated thereby opening the baking burner gas line 136. In order to activate the thermostat or control valve 138, a thermocouple 140 is arranged in communication with the pilot burner 132 and the thermostat or control valve 138 so that once the pilot burner 132 is ignited, the thermocouple 140 will sense the increase in temperature from the gas flame and activate the thermostat 138 thereby establishing gas flow between the first gas line 122 and the baking burner gas line 136 and igniting the first heating element (or baking element) 112.

A battery powered spark ignition module 142 is provided for igniting the pilot burner 132. The spark ignition module 142 is powered by a separate battery pack 144 and is operably coupled to the pilot burner 132 associated with the first heating element 112 through the corresponding control knob 131 as illustrated by control line 135. Therefore, when the user activates the bake setting control knob 131 after having opened the first gas line 124 by means of control knob 130 associated with the gas valve selector 128, the spark ignition module 142 is activated so as to generate a spark which ignites the propane gas supplied to the pilot burner 132 through the pilot burner gas line 134. Once the pilot burner 132 is light, the thermocouple 140 will heat thereby activating the thermostat which in turn will open the baking burner gas line 136. While reference has been made to a battery powered spark ignition module 142, it will be understood that any suitable ignition module may be used that is capable of generating a spark to ignite the pilot burner 132.

In some embodiments, the gas range appliance 100 is also provided with a flame indicator 146 that is operably coupled to the first heating element 112 via control line 147. Therefore, once the first heating element (or baking burner) 112 is ignited, a visual indicator located on the control panel 127 of the gas range 100 is provided confirming that the bake setting is operational so as to provide visual reassurance to the user that the oven compartment 106 is operational and that the gas circuit associated with the bake setting is functioning accordingly. Should the gas flame associated with the pilot burner 132 be snuffed-out at any point during use of the oven compartment 106 while on the bake setting, the thermocouple 140 will de-activate the thermostat or control valve 138 shutting-off the gas supply from the first gas line 122 to the baking burner gas supply line 136.

Alternatively, when the bake setting is no longer required, the user activates the control knob 131 associated with the bake setting which effectively snuffs out the pilot burner 132 which in turn shuts-off the gas supply to the first heating element 112. Once the gas flame from the pilot burner 132 is snuffed-out, the connection between the thermocouple 140 and the thermostat or control valve 130 is broken returning the thermostat or control valve 130 to its normally closed position. The user then also selects the "OFF" position associated with the control knob 130 that is operably coupled to the gas valve selector 128 which deactivates the propane gas supply from the main gas manifold 122 to the first gas supply line 122.

The broil setting operates in a similar manner to the bake setting described above. As set out above, the second heating element (or broil burner) 114 is arranged at the top of the oven compartment 106 for generating heat and directing the heat downwards within the oven compartment 106 for broiling purposes. The second heating element 114 has a corresponding pilot burner 152, the second heating element 114 and pilot burner 152 each being supplied with propane gas through their respective gas supply lines, namely a pilot burner gas line 154 and a broil burner gas line 156 both of which are arranged in fluid communication with the second gas line 126. A thermostat or control valve 158 is arranged at the junction of the second gas line 126 and the broil burner gas line 156 for controlling whether propane gas from the gas manifold 122 is delivered to the second heating element 114 through the broil burner gas line 156, the thermostat or control valve 158 being operably coupled to the pilot burner 152 associated with the second heating element 114 through control circuit or feedback loop 159. Therefore, only once the pilot burner 152 is ignited will the thermostat or control valve 158 be activated thereby opening the broil burner gas line 156. In order to activate the thermostat or control valve 158, a thermocouple 160 is arranged in communication with the pilot burner 152 and the thermostat or control valve 158 via control circuit or feedback loop 159 so that once the pilot burner 152 is ignited, the thermocouple 160 will sense the increase in temperature from the gas flame of the pilot burner 152 and transmit this information back to the thermostat or control valve 158 through the control circuit or feedback loop 159 so as to activate the thermostat 158 thereby establishing gas flow between the second gas line 126 and the broil burner gas line 156 and igniting the second heating element (or broil burner) 114. The pilot burner 152 associated with the second heating element (or broil burner) 114 is operably coupled to the spark ignition module 142 through the corresponding control knob 133 via control line 155. Therefore, similar to operation of the bake setting, once the user has selected the broil setting on the control knob 130 associated with the gas valve selector 128 opening the second gas supply line 126, the user then activates the control knob 133 associated with the broil function thereby opening the pilot burner gas supply line 154 and activating the spark ignition module 142 which generates a spark so as to ignite the propane gas supplied to the pilot burner 152 through the pilot burner gas line 154. Once the pilot burner 152 is ignited, the thermocouple 160 activates the corresponding thermostat or control valve 158 establishing gas flow between the second gas line 126 and the broil burner gas line 156 allowing the second heating element (or broil burner) 114 to ignite generating the top-down heat required for broiling purposes within the oven compartment 106. Similar to the bake setting, should the gas flame associated with the pilot burner 152 of the second heating element 114 be snuffed-out at any point during operation, the thermocouple 160 will de-activate the thermostat or control valve 158 shutting-off the gas supply from the second gas line 124 to the broil burner gas supply line 156.

A second flame indicator 166 associated with the broil setting of the gas range 100 may also be provided, the second flame indicator being operably coupled to the second heating element (or broil burner) 114 via control line 167. Therefore, once the second heating element (or broil burner) 114 is ignited, a visual indicator located on the control panel 127 of the gas range 100 is provided confirming that the broil setting is operational thereby providing visual reassurance to the user that the oven compartment 106 is operational and that the gas circuit associated with the broil setting is functioning accordingly. Should the gas flame associated with the pilot burner 152 fail to light or be snuffed-out at any point during use of the oven compartment 106 on the broil setting, the thermocouple 160 will fail to activate or de-activate the thermostat or control valve 158 effectively shutting-off the gas supply from the second gas line 126 to the broil burner gas supply line 156.

Therefore, by providing two separate gas lines 122, 124 that are interconnected at the main gas manifold 122 by a gas selector 128 that allows a user to select between either the bake or broil setting for the oven compartment effectively ruling out the possibility of both heating elements 112, 114 being operational at the same time contravening known safety regulations, the gas range 100 is provided with a waist-broiler that eliminates the need for the separate broil drawer arranged at the bottom of the appliance.

Figure 5:
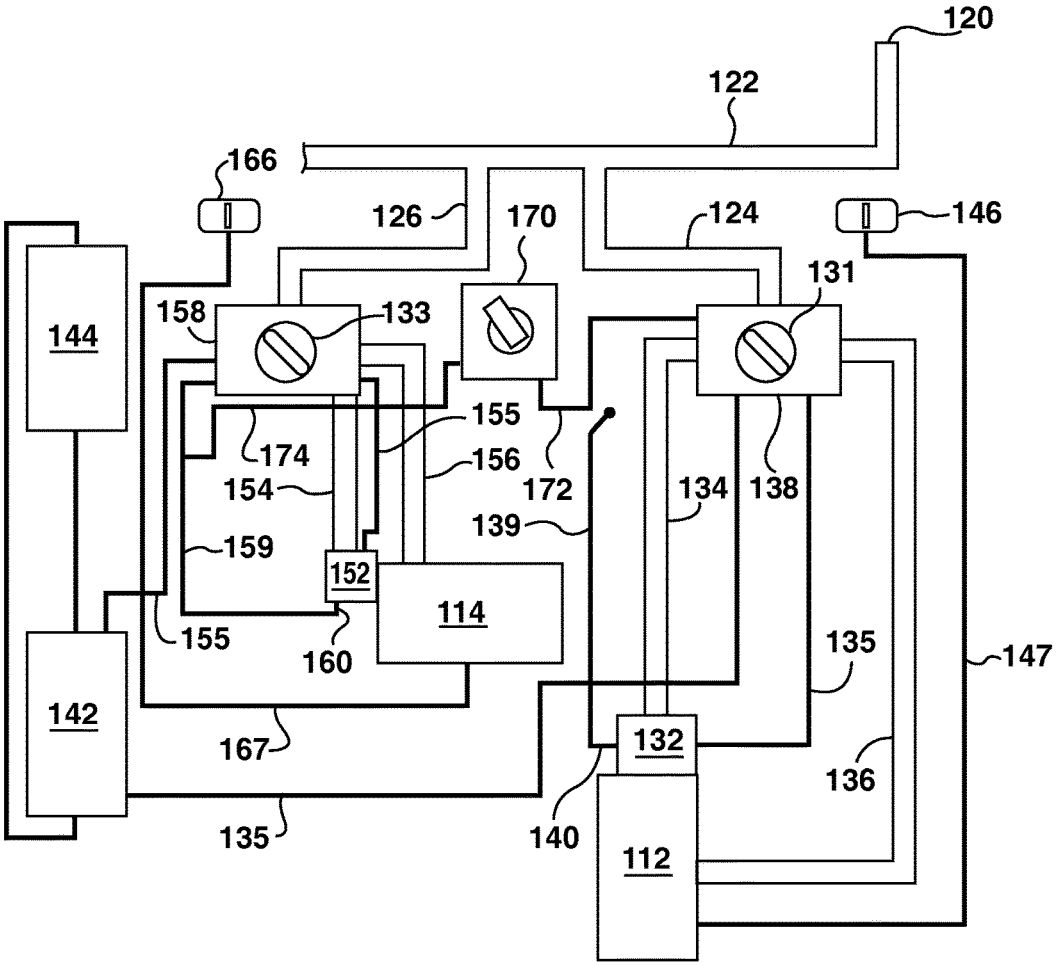
FIG. 5 is a schematic diagram of another example embodiment of the gas circuit associated with the operation of the oven compartment of an off-grid gas range according to an alternate embodiment of the present disclosure illustrating the broil function.

Referring now to FIG. 5 there is shown is schematic diagram illustrating an alternate embodiment of the bake and broil settings of the off-grid gas range appliance 100 according to the present disclosure wherein like reference numerals have been used to identify similar components as described above in connection with the embodiment illustrated in FIG. 4. In the subject embodiment, rather than providing a separate gas selector 128 with a corresponding control knob 130 in order to select between allowing gas to flow through either the first gas supply line 122 to power the bake function or to the second gas supply line to power the broil function, an electronic switch mechanism 170 is provided that allows a user to select between activating one of the bake and broil settings associated with the oven compartment 106 while ensuring that both the bake and broil settings cannot be operational at the same time in accordance with the specific safety regulations mandated for off-grid gas range appliances. Operation of the bake and broil settings using the electronic switch mechanism 170 will be described in further detail below.

Figure 6:
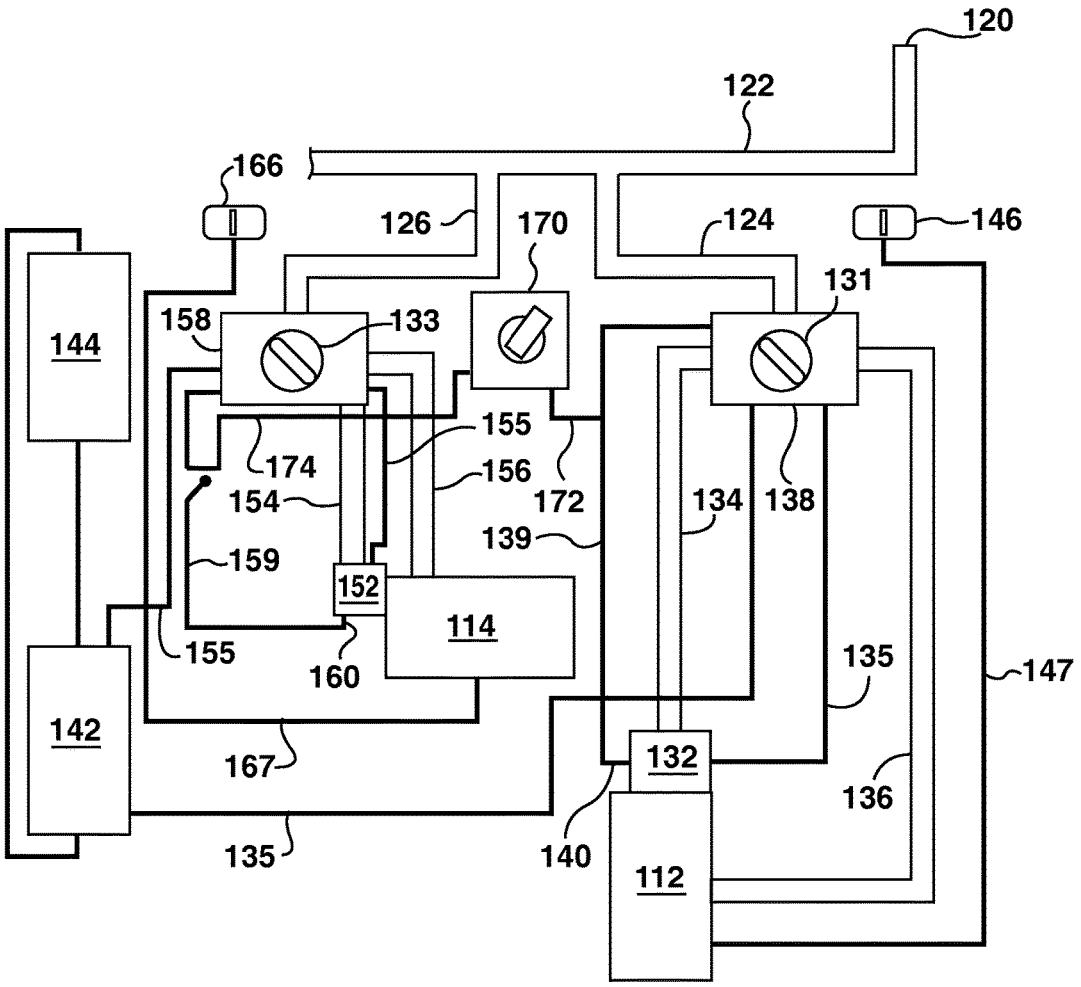
FIG. 6 is a schematic diagram of illustrating the bake function of off grid gas range appliance shown in FIG. 5.

In the subject embodiment, the main gas manifold 122 supplies propane gas to both the first gas line and the second gas line 124, 126. The individual control knobs 131, 133 associated with the oven compartment bake and broil functions remain in their "OFF" position preventing propane gas from being supplied to either of the pilot burners 132, 152 associated with the first and second heating elements 112, 114. When a user wishes to activate one of the bake and broil settings, the user selects the appropriate function by activating the electronic switch mechanism 170. The electronic switch mechanism 170 is operably coupled to the thermocouple circuit associated with the pilot burner 132 for the bake setting as well as to the thermocouple circuit associated with the pilot burner 152 for the broil setting and functions so as to close and/or interrupt the thermocouple circuit 139, 159 for either the pilot burner 132 for the bake setting or the pilot burner 152 for the broil setting via control lines 172 and 174. Therefore, when the user activates the electronic switch mechanism 170 by selecting the "BROIL" setting, as shown for instance in FIG. 5, the thermocouple circuit or feedback loop between the pilot burner 132 for the bake setting and the corresponding thermostat or control valve 138 is broken or interrupted. Therefore, even if one were to try to operate the bake setting by activating the control knob 131 opening the pilot burner gas line 134 and activating the spark ignition module 142 igniting the pilot burner 132, the thermocouple 140 associated with the bake setting pilot burner 132 would not be able to the communicate/transmit this information back to the bake setting thermostat or control valve 138 thereby preventing the bake burner gas line 136 from being opened and releasing propane gas to the baking burner or first heating element 112. Instead, when the user activates the electronic switch mechanism 170 by selecting the "BROIL" setting, only the thermocouple circuit or feedback loop between the pilot burner 152 for the broil setting and the corresponding thermostat or control valve 158 is closed or completed. Therefore, when the user initiates ignition of the broil burner or second heating element 114 by means of the corresponding control knob 133 thereby opening the pilot burner gas line 154 and activating the spark ignition module 142 to generate a spark so as to ignite the pilot burner 152 will the corresponding thermocouple 160 be able to transmit this information back to the thermostat or control valve 158 associated with the broil setting allowing the broil burner gas line 156 to be opened releasing propane gas to the second heating element (or broil burner)114. Similarly, when the user wishes to operate the "BAKE" setting of the gas range appliance 100, the user activates the switch mechanism 170 to the select the alternate active setting, as shown in FIG. 6, which interrupts or breaks the feedback loop 159, 174 between the thermocouple 160 associated with the pilot burner 152 for the second heating element or broil burner 114 which effectively disables the broil function of the oven compartment 106 since the broil burner gas line 156 will not open without positive feedback from the thermocouple 160. Instead, the activation of switch 170 will connect the thermocouple 140 associated with the pilot burner 132 for the first heating element or bake burner 112 to the thermostat or control valve 138 via feedback loop or control circuit 139, 172. Therefore, by having a switch connected to the thermocouple control loops associated with both the first and second heating elements 112, 114, only one of the first and second heating elements 112, 114 can be operational at any one time, thereby meeting mandated safety requirements, without requiring the incorporation of additional gas valves and control knobs into the control panel 107 of the gas range 100, which may facilitate manufacturing of the gas range appliance and may also contribute to overall cost savings associated with eliminating the need for additional more costly and complex components.

While various configurations of the bake and broil functions for the gas range appliance 100 have been disclosed, it will be understood that certain adaptations and modifications of the described embodiments can be made without departing from the scope of the present disclosure. Therefore, the above discussed embodiments are considered to be illustrative and not restrictive.

What is claimed is:

1. An off-grid propane gas range appliance, comprising:

a cooking surface having a plurality of cooking elements, each cooking element having a pilot burner;

an oven compartment;

a first heating element arranged within the oven compartment at a bottom portion thereof for supplying heat to the oven compartment for baking, the first heating element having a gas circuit powering said first heating element;

a second heating element arranged within the oven compartment at a top portion thereof for supplying heat to the oven compartment for broiling, the second heating element having a gas circuit powering said second heating element;

an oven heating element selector having a first position for selecting operation of the first heating element and a second position for selecting the second heating element for operation;

wherein only one of the first and second heating elements is operational at one time;

a gas manifold for delivering propane gas to each of the plurality of cooking elements and each of the first and second heating elements;

a first supply line interconnecting said gas manifold and said first heating element gas circuit;

a second gas supply line interconnecting said gas manifold and said second heating element gas circuit;

a first pilot burner associated with the first heating element;

a first pilot burner gas line interconnecting said first pilot burner and said first gas supply line;

a second pilot burner associated with the second heating element;

a second pilot burner gas line interconnecting said second pilot burner and said second gas supply line;

a first heating element gas line for directing gas from said first gas supply line to said first heating element;

a second heating element gas line for directing gas from said first gas supply line to said second heating element;

a first control valve in fluid communication with said first gas supply line and operably coupled to said first pilot burner for controlling gas flow from said first gas supply line to said first heating element gas line;

a second control valve in fluid communication with said second gas supply line and operably coupled to said second pilot burner for controlling gas flow from said second gas supply line to said second heating element gas line;

wherein said first control valve activates to establish fluid communication between said first gas supply line and said first heating gas element upon ignition of said first pilot burner; and wherein said second control valve activates to establish fluid communication between said second gas supply line and said second heating gas element upon ignition of said second pilot burner.

2. The off-grid propane gas range appliance as claimed in claim 1, wherein said first and second control valves are thermostat devices.

3. The off-grid propane gas range appliance as claimed in claim 1, wherein said first heating element is a baking element and said second heating element is a broiling element.

4. The off-grid propane gas range appliance as claimed in claim 1, further comprising a thermocouple operably connecting each of said first and second pilot burners and the corresponding first or second control valve.

5. The off-grid propane range appliance as claimed in claim 4, wherein said oven heating element selector comprises a control switch electrically connected to each of said thermocouples, and wherein said first position of said oven heating element selector disconnects the thermocouple from said first control valve and wherein said second position of said oven heating element selector disconnects the thermocouple from said second control valve.

6. The off-grid propane gas range appliance as claimed in claim 5, wherein said control switch is a gold plated selector.

7. The off-grid propane gas range appliance as claimed in claim 5, further comprising a battery pack and a spark ignition module, wherein said control switch is powered by said battery pack.

8. The off-grid propane gas range appliance as claimed in claim 4, wherein the oven heating element selector comprises a gas valve selector for establishing fluid communication between said first gas supply and said gas manifold when in said first position or said second gas supply line and said gas manifold when in said second position.

9. The off-grid propane gas range appliance as claimed in claim 4, further comprising an igniter having a spark ignition module and a battery pack powering the spark ignition module, the spark ignition module for igniting said first pilot burner when fluid communication is established between said first gas supply line and said first pilot burner supply line and for igniting said second pilot burner when fluid communication is established between said second gas supply line and said second pilot burner supply line.

10. The off-grid propane gas range appliance as claimed in claim 9, further comprising a flame indicator operably coupled to each of said first and second heating elements, the flame indicator providing visual confirmation of ignition of the first or second pilot burner.

11. The off-grid propane gas range appliance as claimed in claim 9, further comprising a gas valve for controlling gas flow from said first gas supply line and said first pilot burner supply line;

wherein a control knob is operably coupled to said gas valve and said igniter.

12. The off-grid propane gas range appliance as claimed in claim 9, further comprising a gas valve for controlling gas flow from said second gas supply line and said second pilot burner supply line;

wherein a control knob is operably coupled to said gas valve and said igniter.

13. An off-grid propane gas range appliance, comprising:

a cooking surface having a plurality of cooking elements, each cooking element having a pilot burner;

an oven compartment disposed underneath the cooking surface;

a first heating element arranged within the oven compartment at a bottom portion thereof for supplying heat to the oven compartment for baking;

a second heating element arranged within the oven compartment at a top portion thereof for supplying heat to the oven compartment for baking;

a first heating element gas circuit for receiving gas from a gas supply and for delivering gas to the first heating element;

a first pilot burner configured for receiving gas from the first beating element gas circuit;

a first control valve disposed within the first heating element gas circuit for controlling gas flow to the first heating element, the first control valve having a first position establishing gas flow to the first pilot burner and preventing gas flow to the first heating element, and a second position establishing gas flow to the first pilot burner and the first heating element;

a second heating element gas circuit for receiving gas from a gas supply and delivering gas to the second heating element;

a second pilot burner configured for receiving gas from the second heating element gas circuit;

a second control valve disposed within the second heating element gas circuit for controlling gas flow to the second heating element, the second control valve having a first position establishing gas flow to the second pilot burner and preventing gas flow to the second heating element, and a second position establishing gas flow to the second pilot burner and to the second heating element; and an oven heating element selector having a first position for selecting operation of the first heating element and establishing gas flow between the gas supply and the first heating element gas circuit and preventing gas flow to the second heating element gas circuit, and a second position for selecting operation of the second heating element and establishing gas flow between the gas supply and the second heating element gas circuit and preventing gas flow to the first heating element gas circuit;

wherein the first control valve is operable to assume its second position only while the oven heating element selector is in the first position and the first pilot burner is ignited; and the second control valve is operable to assume its second position only while the oven heating element selector is in the second position and the second pilot burner is ignited.

14. The off-grid propane gas range as claimed in claim 13, further comprising:

a gas manifold for delivering propane gas to each of the plurality of cooking elements and each of the first and second heating elements;

a first gas supply line interconnecting the gas manifold and the first heating element gas circuit;

a second gas supply line interconnecting the gas manifold and the second heating element gas circuit;

a first pilot burner gas line interconnecting the first pilot burner and the first gas supply line;

a second pilot burner gas line interconnecting the second pilot burner and the second gas supply line;

a first heating element gas line for directing gas from the first gas supply line to the first heating element;

a second heating element gas line for directing gas from the first gas supply line to the second heating element;

wherein the oven heating element selector establishes fluid communication between the gas manifold and the first gas supply line while in its first position and establishes fluid communication between the gas manifold and the second gas supply line in its second position;

the first control valve establishes fluid communication between the first gas supply line and the first pilot burner gas line in its first position and establishes fluid communication between the first gas supply line, the first pilot burner gas line, and the first heating element gas line in its second position; and the second control valve establishes fluid communication between the second gas supply line and the second pilot burner gas line in its first position and establishes fluid communication between the second gas supply line, the second pilot burner gas line, and the second heating element gas line in its second position.

15. The off-grid propane range appliance as claimed in claim 14, wherein the first and second control valves are thermostat devices.

16. The off-rid propane gas range appliance as claimed in claim 14, further comprising an igniter having a spark ignition module and a battery pack powering the spark ignition module, the spark ignition module for igniting the first pilot burner when fluid communication is established between the first gas supply line and the first pilot burner supply line, and for igniting the second pilot burner when fluid communication is established between the second gas supply line and the second pilot burner supply line.

17. The off-grid propane gas range appliance as claimed in claim 14, further comprising a thermocouple operably connecting each of the first and second pilot burners and the corresponding first or second control valve.

18. The off-grid propane range appliance as claimed in claim 17, wherein the oven heating element selector comprises a control switch electrically connected to each of the thermocouples, and wherein the first position of the oven heating element selector disconnects the thermocouple from the first control valve and wherein the second position of the oven heating element selector disconnects the thermocouple from the second control valve.

19. The off-grid propane gas range appliance as claimed in claim 18, further comprising a battery pack and a spark ignition module, wherein the control switch is powered by the battery pack.

* * * * *